US006182908B1

(12) United States Patent
Hamilton

(10) Patent No.: US 6,182,908 B1
(45) Date of Patent: Feb. 6, 2001

(54) SOLENOID OPERATED HEATED LIQUID SPRAY DEVICE

(75) Inventor: Richard J. Hamilton, West Chicago, IL (US)

(73) Assignee: Spraying Systems Co., Wheaton, IL (US)

( * ) Notice: Under 35 U.S.C. 154(b), the term of this patent shall be extended for 0 days.

(21) Appl. No.: 09/444,929

(22) Filed: Nov. 22, 1999

(51) Int. Cl.[7] ..... B05B 9/03
(52) U.S. Cl. ..... 239/125; 239/583; 239/600
(58) Field of Search ..... 239/124, 125, 239/569, 583, 585.1, 585.4, 585.5, 600

(56) References Cited

U.S. PATENT DOCUMENTS 4,430,886 * 2/1984 Rood ..... 239/525
5,078,325 * 1/1992 Waryu et al. ..... 239/583 X
5,183,322 2/1993 Haruch .
5,294,057 3/1994 Hamilton .
5,385,304 1/1995 Haruch .
5,595,346 1/1997 Haruch et al. .
5,707,010 1/1998 Manfre et al. .

* cited by examiner

*Primary Examiner*—Lesley D. Morris
(74) *Attorney, Agent, or Firm*—Leydig, Voit & Mayer, Ltd.

(57) ABSTRACT

A solenoid operated liquid spray device which includes a flow control module disposed within the solenoid coil of the device for controlling the direction of pressurized through the spray device. The flow control module includes separate inlet and outlet portions which can be easily disassembled for on line service without necessity for disconnecting fluid supply and electric power lines. The outlet portion is secured to the inlet portion by an adjustable retainer which is selectively positionable for adjusting the operating stroke of the valve plunger without the necessity for damaging relative rotational movement between the valve plunger needle and valve seat. The module portions further define a first flow passageway communicating between a liquid inlet and discharge nozzle and a second or return passageway communicating with a heated liquid supply for enabling liquid in the spray device to be maintained at an optimum heated temperature when a spraying operation is interrupted.

31 Claims, 5 Drawing Sheets

SOLENOID OPERATED HEATED LIQUID SPRAY DEVICE

FIELD OF THE INVENTION

The present invention relates generally to solenoid operated spray devices for directing small volume, finely atomized liquid at short operating intervals, and more particularly, to such spray devices that direct heated liquid coating material in continuous can manufacturing operations.

BACKGROUND OF THE INVENTION

Solenoid operated spray devices, such as those used for directing heated liquid coating materials in can manufacturing operations, typically include a needle valve that is reciprocated between on and off positions through actuation of the solenoid at rates of about 300 to 400 cycles per minute, consistent with the rate of advancement of cans, for successively spraying a coating of heated liquid into or on the cans. It is desirable to adjust the stroke of the needle valve for a particular coating and/or spray application.

Heretofore, effecting stroke adjustment in such spray devices has been cumbersome and sometimes causes damage to the valve needle or seat. One procedure, for example, requires removal of the spray tip, disassembly of a retaining nut, and rotation of a valve seat member relative to the spring biased valve needle to force the valve seat upwardly against the biasing force of the needle thereby changing the position of the valve seat, and hence, the distance the needle travels during each operating cycle, i.e. the stroke. Rotational movement of the valve seat against the needle can scuff or damage the valve seat and/or needle and adversely affect subsequent spray performance.

Furthermore, when the spray device is idled, such as during stroke adjustment or during interruption in the can manufacturing line, coating liquid within the gun will cool, such that upon resumption of the spray operation, the cooled liquid will be below the temperature necessary for achieving optimum spray performance and coating.

Servicing of such solenoid operated spray devices also can be a time consuming and costly procedure, often necessitating uncoupling of fluid supply and return lines, disconnection of electric power, and removal of the spray gun from its mounting. Such service procedures can cause significant interruptions in the high speed can manufacturing line.

OBJECTS AND SUMMARY OF THE INVENTION

It is an object of the present invention to provide an improved modular constructed solenoid operated liquid spray device which lends itself to on line service without disconnection of the fluid supply line or electric power.

Another object is to provide a solenoid operated liquid spray device as characterized above in which moving parts of the spray device and the valve shut off seat can be easily and quickly removed and replaced without complete disassembly and/or removal of the spray device from its mounting or liquid supply connection.

Still another object is to provide a solenoid operated liquid spray device of the foregoing type in which the stroke of the needle valve may be adjusted on line to compensate for wear without disconnecting liquid supply lines, mounting fasteners or the spray tip.

A further object is to provide a solenoid operated liquid spray device of the above kind in which the stroke of the needle valve can be easily adjusted without damaging or scratching either the needle or valve seat. A related object is to provide a spray device of such type in which the stroke of the needle valve can be adjusted without relative rotation between the valve seat and needle.

Yet another object is to provide a solenoid operated liquid spray device of the foregoing type that is operable for spraying heated liquids, such as coatings used in automated can manufacturing operations, and which effectively maintains liquid within the spray device at the proper elevated temperature during periods in which the spray device is idle.

Other objects and advantages of the invention will become apparent upon reading the following detailed description and upon reference to the drawings, in which:

Figure 1:
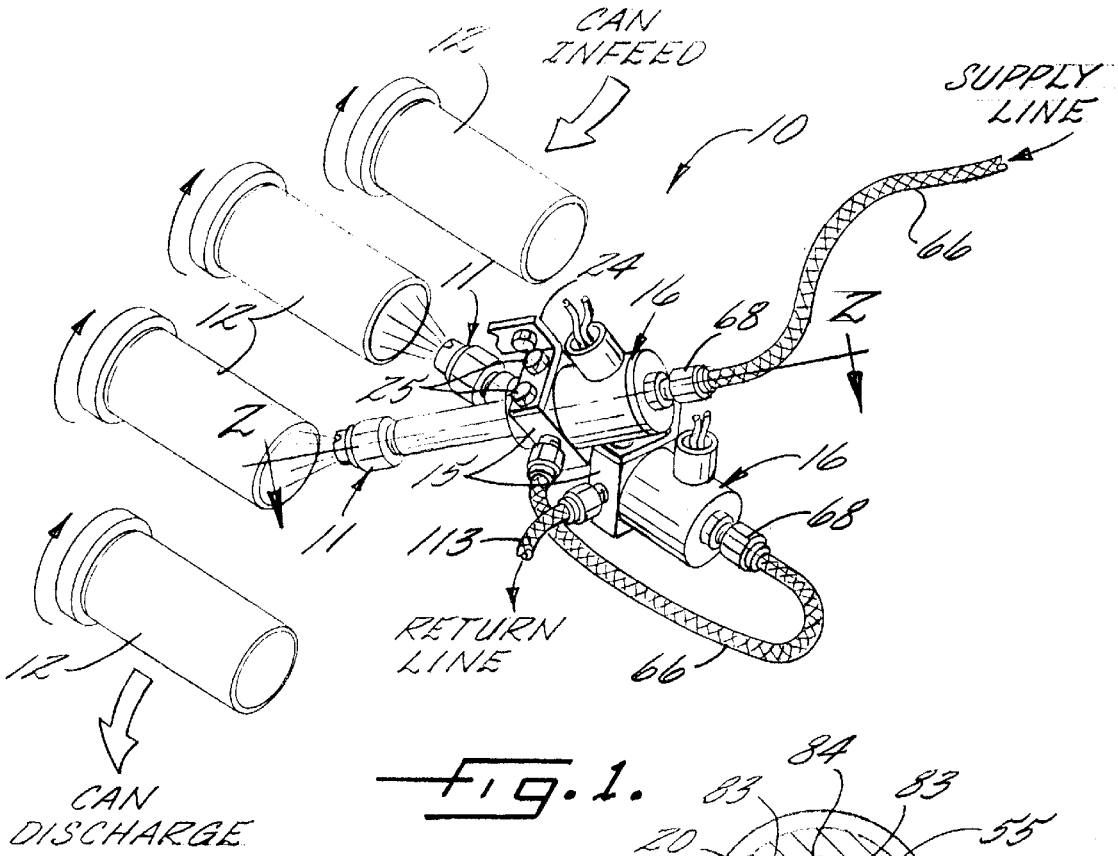
FIG. 1 is a partially diagrammatic depiction of an illustrative spraying system having a plurality of solenoid operated liquid spray devices embodying the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to FIG. 1 of the drawings, there is shown an illustrative spraying system 10 having a plurality of spray devices 11 in accordance with the invention. The spraying system 10 is diagrammatically depicted in a can manufacturing operation for directing liquid spray, such as a heated anti-corrosive lacquer, into the inside of cylindrical can bodies 12 as they pass adjacent the spray devices 11. Since the spray devices 11 are identical in construction, only one will be described in detail.

Figure 2:
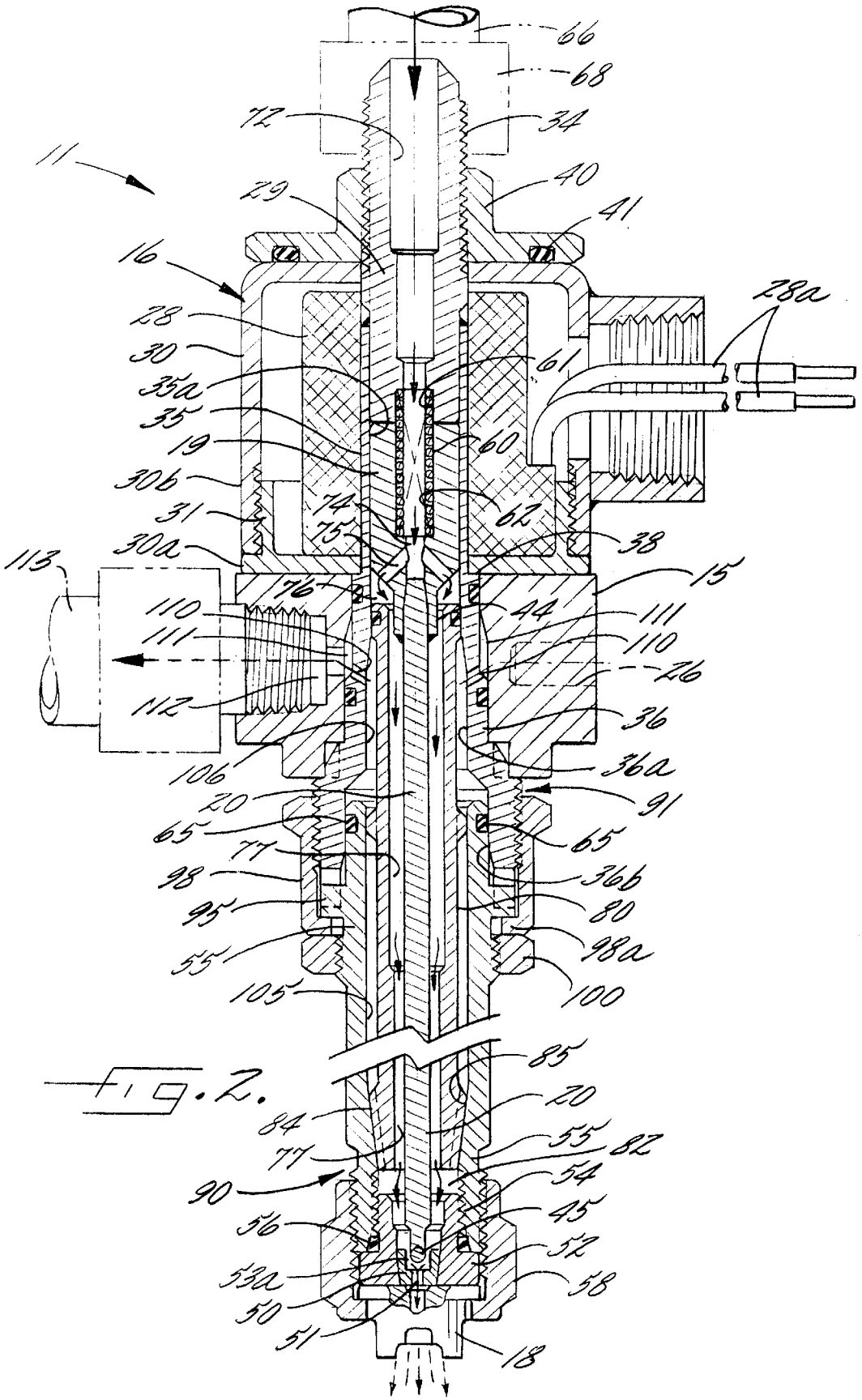
FIG. 2 is an enlarged longitudinal section of one of the spray devices shown in FIG. 1, showing the valve needle in an open position.
Figure 3:
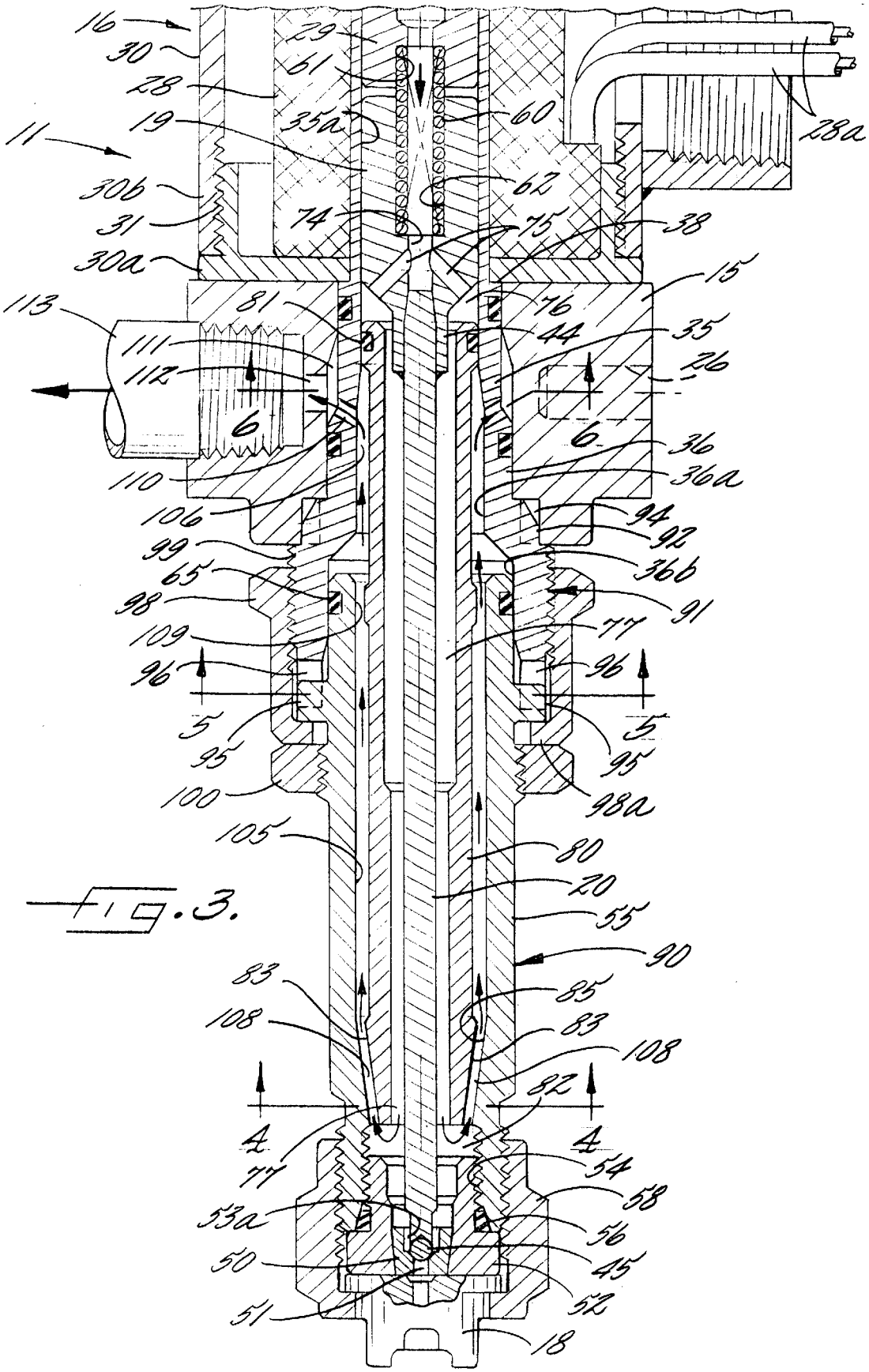
FIG. 3 is an enlarged fragmentary section of the illustrated spray device showing the valve needle in a closed position.

The illustrated spray device 11, as best shown in FIGS. 2 and 3, includes a housing or body 15, a solenoid 16 mounted on the housing 15, a spray nozzle 18 supported at a discharge end of the spray device 11, and a valve plunger 19 having a needle 20 which is mounted for controlled reciprocating movement in response to operation of the solenoid 16 for controlling the discharge of liquid through the spray nozzle 18. To facilitate mounting of the spray device 11, the housing 15 is formed with a flat mounting surface to permit securement to the side of a bracket 24 or the like (FIG. 1) with fastening screws 25 extending through the bracket 24 into threaded engagement with apertures 26 in the housing.

The solenoid 16 includes a solenoid coil 28 with power lines 28*a* and a metallic core 29 disposed centrally within a housing 30. The housing 30 has a two part construction comprising an annular base 30*a* and a generally cylindrical cover 30*b* mounted on the base 30*a*. The cover 30*b* in this instance is screwed onto an upstanding, externally threaded, annular flange 31 of the base 30*a*.

The core 29 is axially disposed within the coil 28 and cover 30*b* with an upstream externally threaded end portion 34 extending outwardly through an axial opening in the cover 30*b* The core 29 has a core tube 35 that defines a cylindrical chamber 35*a* within which the plunger 19 is mounted for reciprocating movement. The core tube 35 is fixed at its upstream end to the core 29, such as by welding, and the downstream end extends through coaxially aligned openings in the cover base 30*a* and body 15. The core tube 35 in this case has an enlarged diameter portion 36 that defines an external shoulder 38 for seating against the end of the cover base 30*a* and progressively larger internal cylindrical chambers 36*a*, 36*b* communicating with the downstream end of the core tube 35.

For securing the solenoid 16 in mounted position on the body 15, a retaining nut 40 is threaded onto the upwardly extending threaded end 34 of the core 29. An O-ring 41 is interposed between the retaining nut 40 and the end of the housing 30 to resist backing off movement of the retaining nut 40.

The valve plunger 19 is disposed within the core tube 35 immediately downstream of the core 29 for limited relative longitudinal movement. The illustrated plunger 19 has an enlarged diameter, upstream end disposed within the coil 28 and a downstream, reduced-diameter end portion 44 within which the needle 20 is fixed. The needle 20 has a ball 45, preferably made of tungsten carbide, brazed or otherwise fixed at its downstream end.

Figure 9:
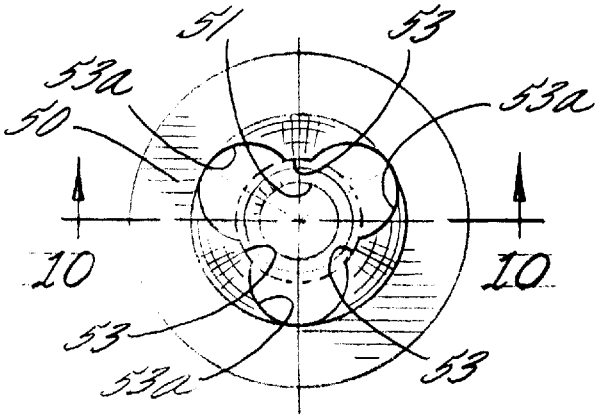
FIG. 9 is a top view of the valve seat of the illustrated spray device.
Figure 10:
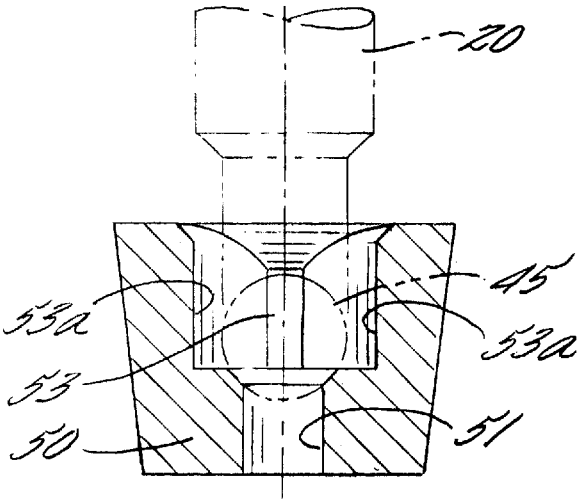
FIG. 10 is an enlarged vertical section of the valve seat taken in the plane of line 10—10 in FIG. 9.

When the valve plunger 19 is in a closed position, as shown in FIG. 3, the ball 45 of the needle 20 is positioned in seated engagement with a valve seat 50 closing the central liquid orifice 51 therein. The valve seat 50, also preferably made of tungsten carbide, in this instance is formed with a plurality of circumferentially spaced inwardly tapered ball guides 53 that guide the valve needle ball 45 into a seated closed position (FIGS. 9 and 10). The valve seat 50 further is formed with a plurality of circumferentially spaced convex channels 53*a* disposed between the ball guides 53 to maximize liquid flow when the valve needle is raised to an open position. The illustrated valve seat 50 is coaxially carried by a seat plug 52 threadedly engageable with a lowermost internally threaded section 54 of a tubular member or body 55 supported in depending relation from the core tube 35. An O-ring seal 56 is interposed between the seat plug 52 and a lower end of the tubular member 55. An upstream end of the tubular member 55 is disposed within the cylindrical chamber 36*b* of the core tube 35 with an O-ring seal 65 interposed therebetween.

The spray nozzle 18 is mounted in axial alignment with the valve seat orifice 51 and is secured in abutting relation to the downstream end of the tubular member 55 by a retaining cap 58 threadedly engageable with an externally threaded downstream end of the tubular member 55. For biasing the valve plunger 19 and needle 20 toward the closed position, a compression spring 60 is contained within opposed axial counterbores 61, 62 in the core 29 and plunger 19, respectively.

For directing liquid to the spray device 11, a liquid supply line 66 is connected to the upstream end 34 of the core 29 by a retaining nut 68 threaded onto the outwardly extending threaded end thereof. As will be understood by one skilled in the art, the liquid supply line 66 is operable for directing fluid to be sprayed, such as liquid coating material used in a continuous can making operation, from an appropriate source which has a heater for maintaining a liquid at an optimum temperature for spraying.

For enabling communication of fluid through the solenoid 16, the core 29 is formed with an axial passageway 72 communicating with the liquid supply line 66. The core passageway 72 communicates with the counterbores 61, 62 in the core 29 and plunger 19, respectively, an axial passage 74 in the plunger 19 downstream of the counterbore 62, and in turn, with a plurality of outwardly angled flow passages 75 in the plunger 19 which communicate with an annular passage 76 defined about a downstream end of the plunger 19.

Figure 4:
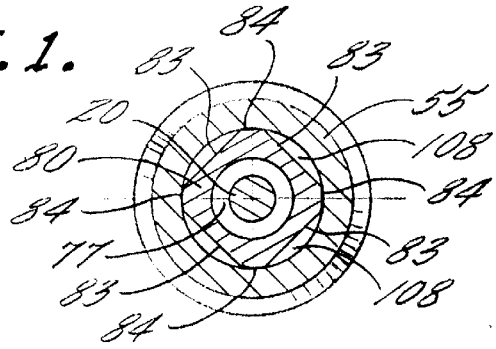
FIGS. 4–6 are large fragmentary sections taken in the planes of lines 4—4, 5—5, and 6—6, respectively, in FIG. 3.
Figure 7:
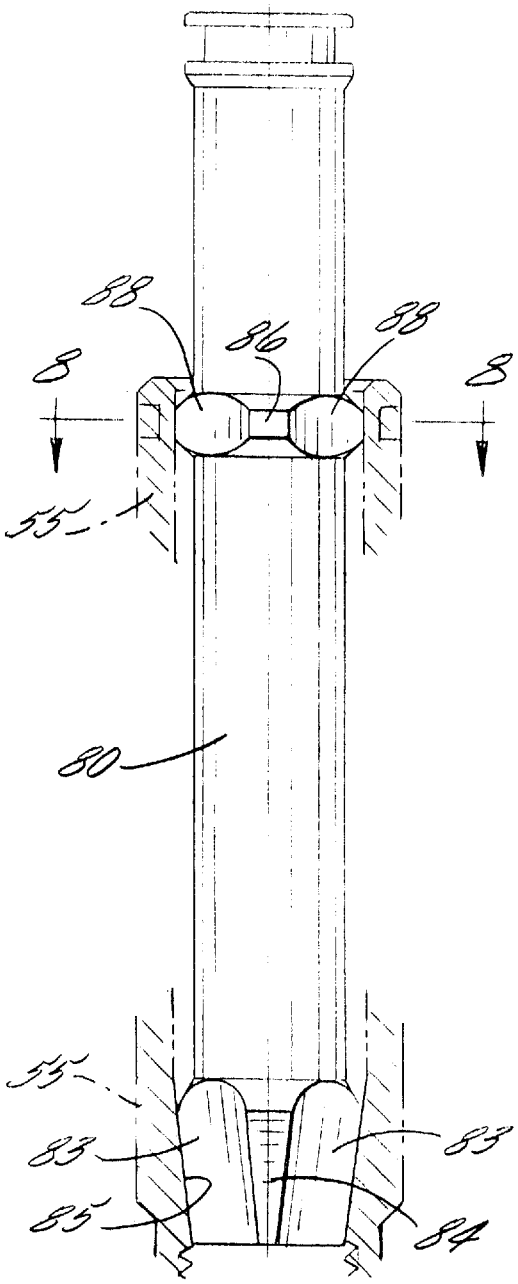
FIG. 7 is a fragmentary section of some of the components of a fluid control module of the illustrated spray device shown in FIG. 3.
Figure 8:
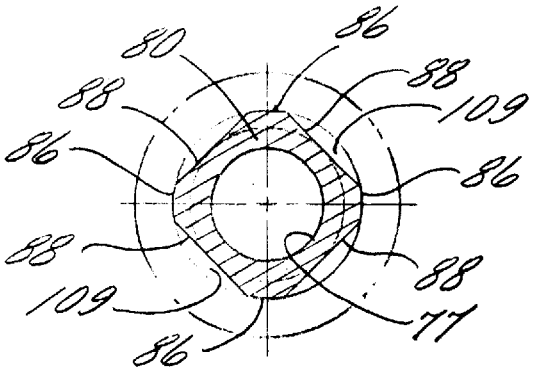
FIG. 8 is section taken in the plane of line 8—8 in FIG. 7.

For defining an annular flow passageway 77 about the needle 20 communicating between the annular passage 76 and the valve seat 50, an inner tubular member or body 80 is concentrically mounted within the tubular member 55 with an upstream end disposed within the core tube 35 immediately downstream of the plunger 19. The downstream end of the inner tubular member 80 is inwardly tapered with flats 83, as viewed in FIGS. 3, 4 and 7, that define corners 84 which are force fit within and supported by an inwardly tapered conical section 85 of the outer tubular member 55. The inner tubular member 80 is further concentrically supported within the outer tubular member 55 by corners 86 defined by flats 88 (FIGS. 7 and 8) of an outwardly extended radial flange located adjacent an upstream end of the outer tubular member 55. An O-ring 81 is interposed between the upper end of the inner tubular member 80 and the core tube 35. Liquid directed to the annular passage 76 communicates through the annular passage 77 defined between the needle 20 and the inner tubular member 80, an annular chamber 82 about the needle adjacent the downstream end of the inner tube 80, and the annular chamber 53*a* communicating with the valve seat orifice 51 when the needle is in an open position.

By selectively energizing the solenoid coil 28, it will be understood that a flux loop is generated through the core 29, plunger 19, base 30*a* and solenoid housing 30, causing the valve plunger 19 and needle 20 to be retracted against the force of the biasing spring 60 to open the valve seat discharge orifice 51 and permit the flow of heated pressurized liquid therethrough. Such retraction of the plunger 19 is limited by engagement of the upstream end of the plunger 19 with the core 29 which establishes the operating stroke of the valve needle. De-energization of the solenoid coil 28 permits the valve plunger 19 to be returned to its closed position under the force of the biasing spring 60. It will be understood by one skilled in the art that by means of an appropriate control, the plunger 19 may be cyclically operated to open and close the valve seat orifice 51 at intervals corresponding to the passage of can bodies adjacent the discharge end of the spray device 11.

Figure 5:
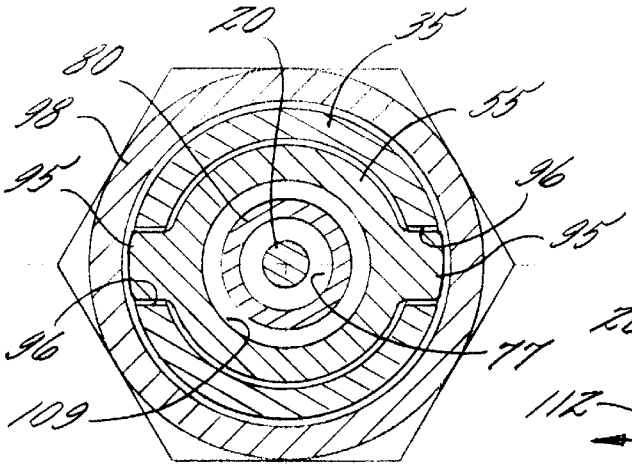

In accordance with one aspect of the invention, components of the spray device comprise a fluid control module that is adapted for easy on line service and valve needle stroke adjustment. More particularly, the fluid control module has inlet and discharge portions which are keyed together and to the housing and which can be easily disassembled for on line service without the necessity for disconnecting fluid supply and electric power lines. In the illustrated embodiment, the outer and inner tubular members 55, 80, plunger 19, needle 20, valve seat 50, seat plug 52, nozzle 18, and retaining cap 58 define a discharge portion 90 of a fluid control module that is removable and replaceable with respect to an inlet portion 91 defined by the core 29 and core tube 35. The inlet module portion 91 is keyed to the housing 15 by means of externally formed keys 92 in the enlarged diameter portion 36 of the core tube 35, which are received in respective longitudinal keyway slots 94 in the downstream or underside of the housing 15 (FIG. 3). The discharge module portion 90 in turn is keyed to the inlet module 91 by means of integrally formed external keys 95 of the outer tubular member 55 that are received in respective longitudinal keyway slots 96 in the downstream end of the core tube 35 (FIG. 5).

Figure 11:
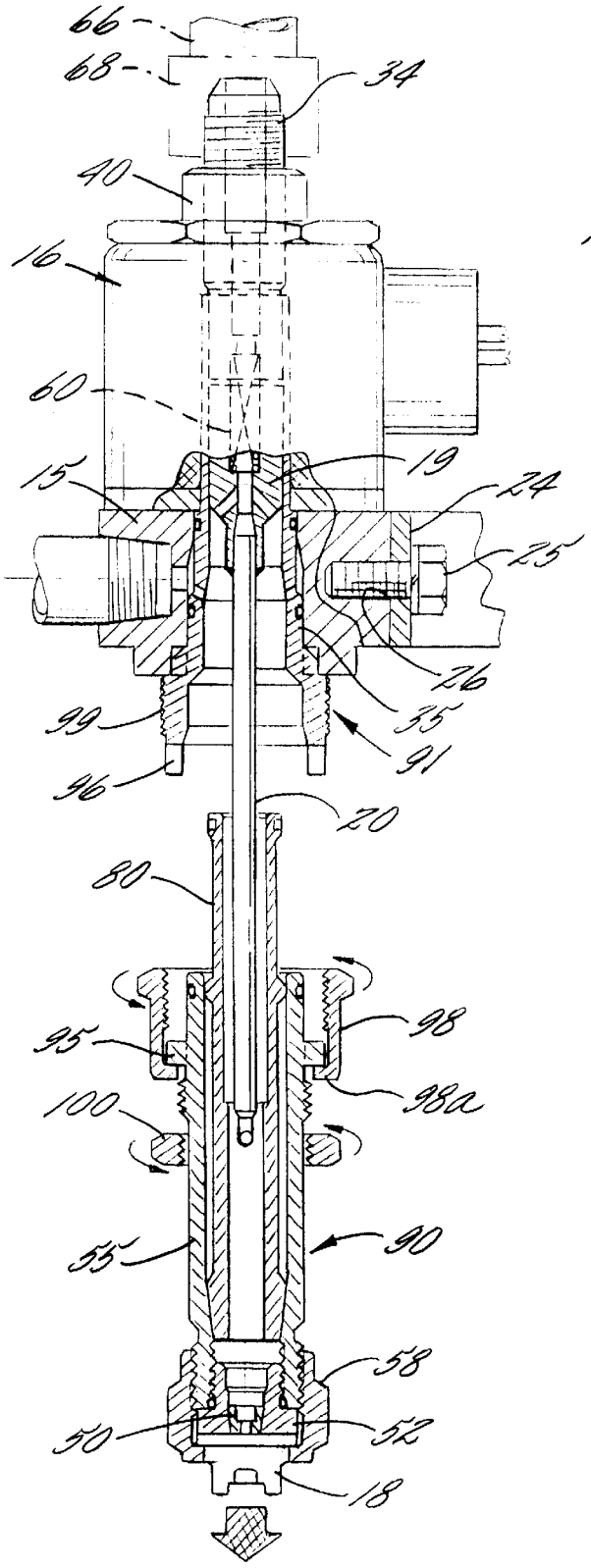
FIG. 11 is a fragmentary vertical section of the illustrative spray device depicting disassembly of the fluid control module thereof.
Figure 12:
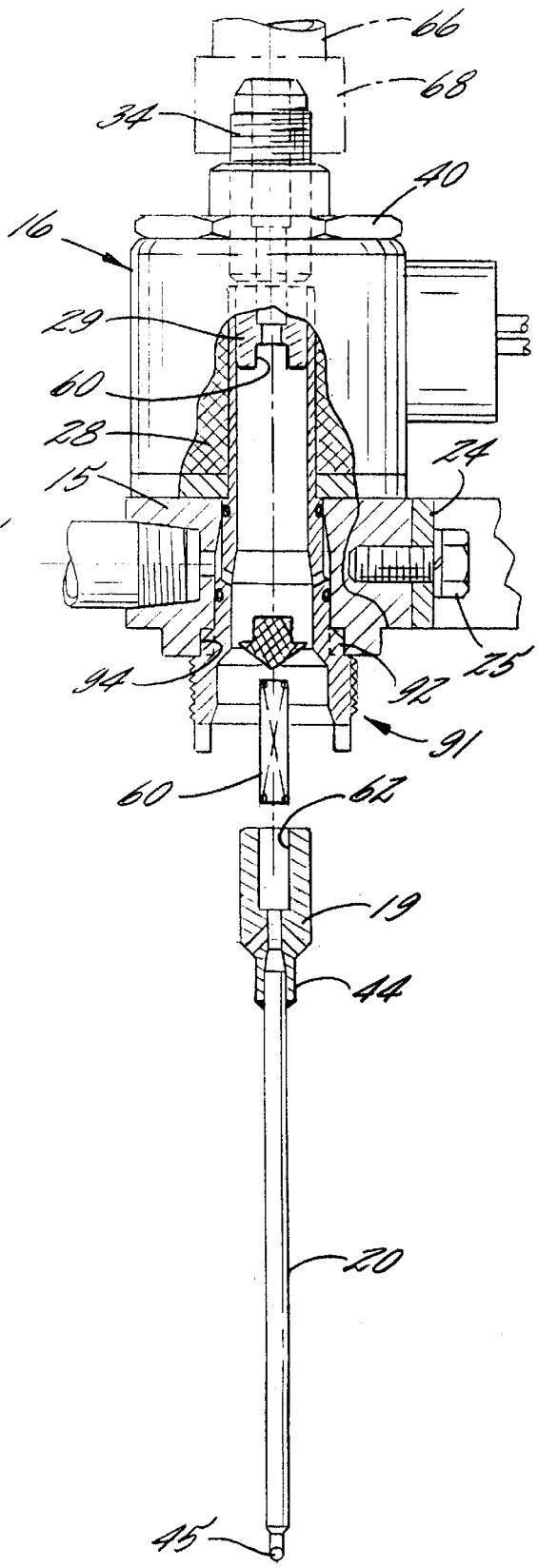
FIG. 12 is a fragmentary section, similar to FIG. 11, showing removal of the valve plunger and needle.

For releasably securing the discharge module portion 90 to the inlet module portion 91, a retainer cap 98 is threaded onto an externally threaded section 99 of the core tube 35 downstream of the housing 15. The retainer cap 98 has an annular flange 98*a* for engaging the downstream end of the outer tubular member keys 95 for supporting and retaining the outer tubular member 55, which in turn supports the other components of the discharge module portion 90. A jam nut 100 in this instance is secured onto a further externally threaded section of the outer tubular member 55 downstream of the threaded section 99 for maintaining the retainer cap 98 in secured relation with respect to the core tube 35. It will be appreciated by one skilled in the art that by simply removing the jam nut 100 and retaining cap 98, the discharge module portion 90 can be removed from the inlet module portion 91, as illustrated in FIGS. 11 and 12. Hence, removal and replacement of the discharge module portion 90 can be quickly and easily effected on line with minimal interruption in the spraying operation. Such servicing on line does not require disconnection of any fluid or electrical supply lines, nor disturb the spray device mounting. Alternatively, if necessary or desired, the entire fluid control module can be removed and replaced by disconnecting the fluid supply line 66, disengaging the retaining nut 40, and lowering and removing the fluid control module 90, 91 from the solenoid housing 30 and spray device housing 15.

In carrying out a further important feature of the invention, the stroke of the valve needle 20 may be selectively adjusted without the need for any disassembly of the spray device or relative rotation between the valve seat 50 and the needle 20. To this end, the discharge module portion 90 is supported by the retaining cap 98 such that clockwise rotation of the retaining cap 98 will advance the retaining cap in an upstream direction on the threaded section 99 of the core tube 35, in turn, lifting the discharge module portion 90, including the plunger 29 and valve needle 20 relative to the core 29 of the inlet module portion, effectively reducing the spacing between the upstream end of the plunger 19 and the core 29, and thereby reducing the distance of plunger travel, i.e., the stroke, during an operating cycle. To accommodate such relative longitudinal adjustment of the outer tubular member 55 with respect to the core tube 35, the keyway slots 96 in the core tube 35 extend in an upstream direction a sufficient distance to permit the relative longitudinal movement of the core tube keys 95 as an incident to such stroke adjustment. The keyed connection 92, 94 between the core tube 35 and the housing 15 prevents rotational movement of the core tube 35 during such stroke adjustment. Likewise, the keyed connection 95, 96 between the discharge module portion 90 and the core tube 35 similarly prevents rotational movement of the discharge module portion 90 relative to the core tube 35 during stroke adjustment or during engagement and disengagement of the nozzle retaining cap 58 from the discharge module portion. Rotation of the retaining cap 98 in a counterclockwise direction will similarly lower the discharge module portion 90, and hence the valve plunger 19 and needle 20, relative to the core tube 35, increasing the stroke of the valve needle 20. The O-rings 65, 81 permit longitudinal movement of the inner and outer tubular members 80, 55 on the respective cylindrical sections of the core tube 35 as an incident to such stroke adjustment while maintaining a sealed relationship. It can be seen, therefore, stroke adjustment of the valve needle used can be quickly effected without any disassembly of the spray device. Moreover, since the stroke adjustment is effected without any relative rotation of movement between the valve seat 50 and needle ball 45, those critical flow control elements are not susceptible to scratching or damage as an incident to stroke adjustment as heretofore been the case with prior art spray devices.

Figure 6:
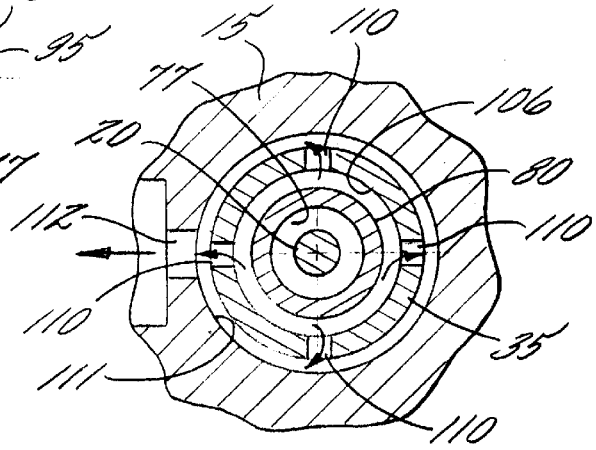

In keeping with a further feature of the invention, the inner and outer tubular members define a liquid return passageway that originates at a point adjacent the valve seat and is part of a closed loop recirculation path for enabling liquid in the spray device to be maintained at an optimum heated temperature when a spraying operation is interrupted, such that upon resumption of spraying, the liquid within the spray device is at a proper temperature for optimum spray performance. The inner and outer tubular members 80, 55 in this case define an annular flow return passage 105 communicating between the upstream end of the valve seat 50 and an annular passage 106 defined between the upstream end of the inner tubular member 80 and the core tube 35. The flats 83, 88 and comers 84, 86 define circumferentially spaced flow passages 108, 109 (FIGS. 4 and 8) respectively about the inner tubular member 80 at its points of support within the outer tubular member 55 for permitting liquid flow through the annular passages 105, 106. The annular passage 106 in this case communicates through a plurality of angled passages 110 in the core tube 35 (FIG. 6), which in turn communicate with an annular passage 111 communicating with a return port 112 connected to the return lines 113 of the heated liquid supply. When the valve needle 20 is in a closed position for prolonged periods, such as during interruption in the spray operation, it can be seen that substantially all of the liquid within the spray device will continue to circulate through the closed loop recirculation path, such that upon resumption of spraying, liquid discharging from the spray device is at the heated temperature for optimum spray performance.

From the foregoing, it can be seen that the modular constructed spray device of the present invention lends itself to quick and relatively easy on line service without disconnection of fluid supply or electric power lines and without complete disassembly or removal of the spray device from its mounting. The spray device further permits on line adjustment of the stroke of the needle valve without any disassembly and without rotational movement between the valve needle and the valve seat. The spray device is further operable for continuously recirculating heated liquid through the device during periods in which spraying operations are interrupted, such that upon resumed spraying, the liquid within the spray device is at a temperature for optimum spray performance.

What is claimed:

1. A liquid spray device comprising a housing, a liquid inlet for connection to a pressurized liquid supply, a solenoid coil supported by said housing for connection with a power source, a fluid control module disposed within said solenoid coil and having a discharge orifice adjacent a downstream end thereof, said fluid control module having an inlet portion and a separate outlet portion, said inlet portion being removably mounted on said housing with a first keyed connection that prevents relative rotational movement of said inlet portion relative to said housing, said outlet portion being removably mounted on said inlet portion with a second keyed connection that prevents relative rotational movement of said outlet portion with respect to said inlet portion, said module outlet portion including at least one tubular member and a plunger, said plunger being movable relative to said tubular member in response to actuation of said solenoid between a first position for preventing the flow of liquid through said discharge orifice and a second position for permitting the flow of liquid from said inlet through said discharge orifice and spray device for discharge as a spray, a retainer releasably securing said outlet module portion to said inlet module portion, and said retainer being releasable to permit removal of said outlet module portion from said inlet module portion without disconnection of said liquid inlet from said liquid supply and without disconnection of said solenoid from said power source.

2. The liquid spray device of claim 1 in which said inlet module portion includes a core, said retainer supporting said outlet portion in mounted position on said inlet portion and being adjustably positionable with respect to said inlet portion for adjusting the axial position of said tubular member with respect to said inlet modular portion and the axial position of said plunger relative to said inlet module portion core when in said first position.

3. The fluid spray device of claim 2 in which said retainer is a retaining cap for threadable engagement with an externally threaded section of said inlet module portion.

4. The liquid spray device of claim 1 in which said inlet module portion includes a core and a core tube extending in downstream relation to said core, said plunger being mounted for relative axial movement within said core tube, and said inlet module portion being removably mounted on said housing.

5. The liquid spray device of claim 1 in which said inlet module portion includes a core, said outlet module portion including a valve seat defining said discharge orifice mounted in fixed relation to said tubular member, said plunger being positionable into and out of engagement with said valve seat for closing and opening said liquid discharge orifice, said plunger having an operating stroke defined by a distance of travel between said core and said valve seat, said retainer being adjustably positionable, and said valve seat being axially positionable with respect to said core in response to adjustment of said retainer for selectively adjusting the operating stroke of said valve plunger.

6. The liquid spray device of claim 1 in which said first keyed connection comprises external keys on said inlet portion received in longitudinal keyways in said housing, and said second keyed connection comprises external keyways formed on said tubular member and longitudinal keyways formed in a downstream end of said inlet module portion.

7. The liquid spray device of claim 1 in which said plunger has a valve needle fixed to the downstream end thereof, said outlet portion including a first tubular member having a valve seat that defines said discharge orifice and is engagement by said valve needle when said plunger is in said first position, and said outlet module portion including a second tubular member disposed concentrically within said first tubular member and which defines a first liquid passageway for permitting communication of liquid from said inlet to said discharge orifice.

8. The spray device of claim 7 in which said spray device includes a return outlet for connection to said liquid supply, and said first and second tubular members defining a second passageway separate from said first passageway communicating between a location adjacent said discharge orifice and a location adjacent said return outlet for permitting recirculation of liquid within said module to said liquid supply when said plunger is in said first position.

9. A liquid spray device comprising a housing, a liquid inlet for connection to a pressurized liquid supply, a solenoid coil supported by said housing for connection with a power source, a fluid control module disposed within said solenoid coil for controlling the direction of liquid through said spray device, said module having an inlet portion and an outlet portion, said module outlet portion including at least one body member and a valve plunger, said plunger being axially movable relative to said body member in response to actuation of said solenoid between a first position for preventing the flow of liquid through said spray device and a second position for permitting the flow of liquid through said device for discharge as a spray, said plunger having an operating stroke established by the distance of travel between said first and second positions, a retainer securing said outlet portion in predetermined axial relation to said inlet portion, and said retainer being adjustable for selectively adjusting the axial position of said outlet portion with respect to said inlet portion and the operating stroke of said plunger as an incident to adjustable positioning of said retainer.

10. The liquid spray device of claim 9 in which said retainer is adjustably engageable with said inlet portion for adjusting an axial position of said body member with respect to said inlet modular portion and the axial position of said plunger relative to said first module portion when in said first position.

11. The fluid spray device of claim 10 in which said retainer is a retaining cap for threadable engagement with an externally threaded section of said inlet module portion.

12. The liquid spray device of claim 9 in which said inlet module portion includes a core, said outlet module portion including a valve seat having a discharge orifice mounted in fixed relation to said body member, said valve plunger being positionable into and out of engagement with said valve seat for closing and opening said liquid discharge orifice, said plunger operating stroke being defined by a distance of travel between said core and said valve seat, and said valve seat being axially positionable with respect to said core in response to adjustment of said retainer for selectively adjusting the operating stroke of said plunger.

13. The liquid spray device of claim 12 in which said outlet module portion includes a removable discharge nozzle adjacent a downstream side of said valve seat.

14. A liquid spray device comprising a housing, a liquid inlet for connection to a pressurized liquid supply, a solenoid supported by said housing, said solenoid including a coil for connection to a power source and a core disposed axially within to said coil, a body member mounted in depending relation to said solenoid, said body member having a valve seat with a discharge orifice, a valve plunger for movement relative to said body member in response to actuation of said solenoid coil between a first position for preventing the flow of liquid through said valve seat orifice and a second position for permitting the flow of liquid through said valve seat orifice, said plunger having an operating stroke established by the distance of travel between said valve seat and said core, and an adjustably positionable retainer for securing said body member in mounted position and for axially raising and lowering said body member and valve seat with respect to said core as an incident to adjustable positioning of said retainer.

15. The liquid spray device of claim 14 in which said retainer is a retaining cap that supports said body member and threadedly engages an externally threaded section of said spray device.

16. The liquid spray device of claim 15 in which said core includes a core tube extending in downstream relation to said core, said plunger being mounted for relative axial movement within said core tube, and said retaining cap is engageable with an externally threaded section of said core tube.

17. The liquid spray device of claim 16 in which said body member has a keyed connection with said core tube which permits relative axial movement of said body member with respect to said core tube.

18. The liquid spray device of claim 17 in which said core has a keyed connection to said housing, and said core is removably secured to said housing.

19. A liquid spraying system comprising a heated liquid supply for supplying liquid at a desired heated temperature;

a spray device having a housing;

said liquid spray device having a liquid inlet for connection to said heated liquid supply;

a solenoid coil supported by said housing for connection to an electrical source;

a fluid control valve mechanism disposed within said solenoid coil for controlling the flow of liquid from said liquid inlet through a discharge orifice adjacent a downstream end of said spray device, said spray device defining a first liquid passage for communicating liquid from said liquid inlet to said discharge orifice, said fluid control mechanism including a valve plunger movable between a first position for preventing the flow of liquid through said discharge orifice and a second position for permitting the flow of liquid from said liquid inlet through said discharge orifice and direction from said spray device, said solenoid coil being selectively operable for moving said plunger between said first and second positions, said spray device having a liquid return outlet separate from said liquid inlet for connection to said heated liquid supply, said spray device defining a second liquid passage separate from said first liquid passage and extending from a location adjacent said discharge orifice to said return outlet, and said first and said liquid passages defining part of a closed loop recirculation path with said heated liquid supply so that during periods when said plunger is in said first position said liquid is circulated through said recirculation path and substantially all of the liquid within said spray device is maintained at said desired heated temperatures.

20. The liquid spraying system of claim 19 in which said plunger includes a valve needle, and said first passageway is an annular passage about said valve needle.

21. The liquid spraying system of claim 20 in which said second passage is an annular passage disposed about said first annular passage.

22. The spraying system of claim 9 in which said fluid control mechanism includes a valve seat which defines said discharge orifice, a discharge nozzle removably mounted on said fluid control mechanism adjacent a downstream side of said valve seat, said valve plunger being positionable into and out of engagement with said valve seat for closing and opening said liquid discharge orifice, and said second passageway communicates from a location adjacent an upstream side of said valve seat.

23. The liquid spraying system of claim 19 in which said fluid control mechanism includes a cylindrical core adjacent an upstream end of said plunger and a cylindrical core tube extending downstream of said core, said plunger being mounted for relative longitudinal movement in said tube, and said first passageway communicates through said core, core tube and plunger.

24. The spraying system of claim 20 in which said first passageway includes an annular passage defined between said valve needle and a first tubular member concentrically disposed about said valve needle, and said second passageway includes an annular passage defined between said first tubular member and a second tubular member disposed concentrically about said first tubular member.

25. The spraying system of claim 24 in which said fluid control mechanism includes a valve seat which defines said discharge orifice, said valve needle being positionable into and out of engagement with said valve seat for closing and opening said discharge orifice, said first and second tubular members and said valve seat defining a portion of a removable fluid control module disposed in depending relation from said solenoid coil, and a releasable retainer for removably securing said removable fluid control module portion in mounted position.

26. The spraying system of claim 25 in which said fluid control mechanism includes a cylindrical core adjacent an upstream end of said plunger and a cylindrical core tube extending downstream of said core, said plunger being mounted for relative axial movement in said tube, said retainer is a retaining cap that supports said outer tubular member and is threadedly engageable with an externally threaded section of said core tube.

27. The liquid spraying system of claim 26 in which said plunger has an operating stroke defined by the distance of movement of said plunger between said first and second positions, and said retaining cap is adjustably positionable on said threaded core tube section for selectively adjusting the operating stroke of said plunger.

28. A liquid spraying system comprising a heated liquid supply for supplying liquid at a desired heated temperature;

a spray device having a housing;

said spray device having a liquid inlet for connection to said heated liquid supply;

a solenoid coil supported by said housing for connection to an electrical source;

a fluid control module disposed within said solenoid coil and having a discharge orifice adjacent a downstream end thereof, said fluid control module being removably mountable in depending relation to said housing, said fluid control module defining a first liquid passage for communicating liquid from said liquid inlet to said discharge orifice, said fluid control module including a valve plunger movable between a first position for preventing the flow of liquid through said discharge orifice and a second position for permitting the flow of liquid from said liquid inlet through said nozzle for direction from said spray device, said solenoid coil being selectively operable for moving said plunger between said first and second positions, said spray device having a liquid return outlet separate from said liquid inlet for connection to said heated liquid supply, said fluid control module defining a second liquid passage separate from said first liquid passage and extending from a location adjacent said discharge orifice to said return outlet, and said first and said liquid passages defining part of a closed loop recirculation path with said heated liquid supply so that during periods when said plunger is in said first position liquid is circulated through said recirculation path and substantially all of the liquid within said spray device is maintained at said desired heated temperature.

29. The liquid spraying system of claim 28 in which said plunger includes a valve needle, and said first passageway is an annular passage about said valve needle.

30. The liquid spraying system of claim 29 in which said second passage is an annular passage disposed about said first annular passage.

31. The spraying system of claim 30 in which said first passageway includes an annular passage defined between said valve needle and a first tubular member concentrically disposed about said valve needle, and said second passageway includes an annular passage defined between said first tubular member and a second tubular member disposed concentrically about said first tubular member.

* * * * *